US007990246B2

(12) United States Patent
Lindholm et al.

(10) Patent No.: US 7,990,246 B2
(45) Date of Patent: Aug. 2, 2011

(54) FOIL WINDING PULSE TRANSFORMER

(75) Inventors: Mikael Rolf Lindholm, Enköping (SE); Bengt Anderberg, Uppsala (SE)

(73) Assignee: Scandinova Systems AB, Uppsala (SE)

( * ) Notice: Subject to any disclaimer, the term of this patent is extended or adjusted under 35 U.S.C. 154(b) by 104 days.

(21) Appl. No.: 11/991,805

(22) PCT Filed: Sep. 18, 2006

(86) PCT No.: PCT/SE2006/001062

§ 371 (c)(1),
(2), (4) Date: Sep. 8, 2009

(87) PCT Pub. No.: WO2007/035155

PCT Pub. Date: Mar. 29, 2007

(65) Prior Publication Data

US 2009/0322462 A1 Dec. 31, 2009

Related U.S. Application Data

(60) Provisional application No. 60/718,314, filed on Sep. 20, 2005.

(51) Int. Cl.

| | |
|---|---|
| ***H01F 27/24*** | (2006.01) |
| ***H01F 27/06*** | (2006.01) |
| ***H01F 21/04*** | (2006.01) |
| ***H01F 21/02*** | (2006.01) |
| ***H01F 27/28*** | (2006.01) |
| ***H01F 27/29*** | (2006.01) |
| ***H01F 27/30*** | (2006.01) |
| ***H01F 7/06*** | (2006.01) |

(52) U.S. Cl. ..... 336/213; 336/65; 336/128; 336/145; 336/183; 336/184; 336/192; 336/206; 336/220; 336/222; 29/605

(58) Field of Classification Search ..... None
See application file for complete search history.

(56) References Cited

U.S. PATENT DOCUMENTS 3,264,592 A * 8/1966 Pearson ..... 336/182

(Continued)

FOREIGN PATENT DOCUMENTS

EP 0 262 329 4/1988

(Continued)

OTHER PUBLICATIONS

International Search Report for PCT/SE2006/001062 dated Aug. 8, 2007.

(Continued)

*Primary Examiner* — Anh T Mai
*Assistant Examiner* — Mangtin Lian
(74) *Attorney, Agent, or Firm* — Nixon & Vanderhye P.C.

(57) ABSTRACT

A pulse transformer arrangement (100) is built from an uncut pulse transformer core (110) and at least one foil winding (120-A, 120-B) (each) comprising multiple insulated conducting strips arranged around the core and ending in foil winding terminals to form multiple independent primary windings. This new design principle has several advantages. Making the winding(s) of foil eliminates the need to cut the core, because of the ease of insertion of the foil winding(s) onto the core. The work to set up a plurality of primary windings is significantly reduced. In addition to the elimination of the costs for cutting the core, this also brings the further advantages of reduced DC reset current, reduced risk for electrical shorts and avoidance of excessive losses due to potential high frequency AC resistance problems.

15 Claims, 6 Drawing Sheets

U.S. PATENT DOCUMENTS

| | | | | |
|---|---|---|---|---|
| 4,079,324 | A * | 3/1978 | Chesnel | 327/108 |
| 4,086,552 | A | 4/1978 | Baggermans | |
| 4,092,621 | A * | 5/1978 | Nyswander et al. | 336/184 |
| 5,684,341 | A * | 11/1997 | Steingroever | 307/16 |
| 5,805,045 | A | 9/1998 | Henninger | |
| 5,905,646 | A | 5/1999 | Crewson et al. | |
| 6,573,820 | B2 * | 6/2003 | Yamada et al. | 336/184 |
| 6,741,484 | B2 | 5/2004 | Crewson et al. | |
| 6,930,582 | B2 | 8/2005 | Ball | |
| 2002/0067238 | A1 * | 6/2002 | Leu | 336/221 |

FOREIGN PATENT DOCUMENTS

| | | | |
|---|---|---|---|
| EP | 0262329 | | 4/1988 |
| JP | 51-030264 | B | 8/1976 |
| JP | 58-128714 | A | 8/1983 |
| JP | 63-070407 | A | 3/1988 |
| JP | 07-312313 | A | 11/1995 |
| JP | 11-016749 | A | 1/1999 |

OTHER PUBLICATIONS

Translation of Japanese official action, Oct. 20, 2010, in corresponding Japanese Application No. P2008-531059.

"*Aluminum and Copper Foil Transformers*", Technical Information, ElectroCube, www.electrocube.com, Aug. 2006.

* cited by examiner

120

FOIL WINDING PULSE TRANSFORMER

This application is the U.S. national phase of International Application No. PCT/SE2006/001062 filed 18 Sep. 2006 which designated the U.S. and claims priority to U.S. Provisional No. 60/718,314 filed 20 Sep. 2005, the entire contents of each of which are hereby incorporated by reference.

TECHNICAL FIELD

The present invention relates to pulse transformers, a novel winding arrangement as well as a method of efficiently making a pulse transformer with such a winding arrangement.

BACKGROUND

Electrical power systems can be found in virtually all industrial areas, and they normally involve some form of circuitry for controllably transferring electrical power or energy to the intended load. A particular example of a commonly used power system is a power modulator, which can be regarded as a device that controls the flow of electrical power. When a power modulator is designed for generating electrical pulses it is also referred to as a pulse modulator or pulse generator. In its most common form, a power modulator delivers high power electrical pulses to a specialized load. By way of example, high power electrical pulses are utilized for powering microwave amplifier tubes in driving electron accelerator systems and/or microwave generating systems for applications such as medical radiation applications and radar applications.

A key component in power modulators is the pulse transformer, which basically comprises a transformer core, one or more primary windings and one or more secondary windings. The pulse transformer is used for transferring pulse energy from the primary side to the secondary side, normally with a change in voltage and current. The transformer core is made of some magnetic material, and the windings are generally made of copper wires. In operation, the transformer is often placed in a pulse transformer tank, where a suitable fluid such as oil can cool the components efficiently and provide electrical insulation.

Transformer cores for short pulses in the range of a few microseconds are usually made of wound tape of silicon iron. This tape is typically only 0.05 mm thick. This is necessary for the reduction of losses in the core. To allow for practical application of the coils/windings, the core is generally cut into two halves. When the halves are reconnected, the gap left must be minimized and therefore the surfaces have to be ground flat and possibly etched to eliminate shorts between the tape layers. There must also be a thin insulation between the halves for this reason.

SUMMARY

The present invention overcomes these and other drawbacks of the prior art arrangements.

It is a general object to provide an improved pulse transformer design.

It is also an object to provide a novel method of manufacturing a pulse transformer arrangement.

The technology described in this application proposes a new way to design a pulse transformer arrangement. The conventional way is to cut a transformer core into halves, insert windings on the cut core and reconnecting the core halves while minimizing the gap between the halves. The technology described in this application, on the other hand, provides a pulse transformer arrangement which is built from an uncut pulse transformer core and a foil winding comprising multiple insulated conducting strips arranged around the core and ending in foil winding terminals to form a set of multiple independent primary windings.

This new design principle has several advantages. Making the winding(s) of foil eliminates the need to cut the core, because of the ease of insertion of the foil winding(s) onto the core. The work to set up a plurality of primary windings is significantly reduced. In addition to the elimination of the costs for cutting the core, this also brings the further advantages of reduced DC reset current, reduced risk for electrical shorts and avoidance of excessive losses due to potential high frequency AC resistance problems.

Preferably, the multiple primary windings and their terminations may be formed on a single conducting foil deposited on an insulating foil. Advantageously, the multi-strip foil winding only needs to be wrapped a single turn around the uncut transformer core to form a plurality of independent (i.e. insulated from each other) primary windings with end terminals ready for connection. The connections can then be made for example simply by attaching standard multi-pin connectors or any other conventional connection arrangement to the ends of the conducting foil strips.

It is also possible to efficiently form a secondary winding by displacing the wire pattern of a multi-strip foil winding by one strip when the foil is wrapped around the core and soldering the meeting ends together to form a secondary winding with a single starting end and a single terminating end.

The technology described in this application offers at least the following advantages:

- Cost-effective design.
- Reduced manufacturing costs.
- Reduced DC reset current.
- Reduced risk for electrical shorts.
- Avoidance of excessive losses due to potential high frequency AC resistance problems.
- Decreased inductance and reduced risk for sparking.

Other advantages will be appreciated when reading the below description of example, non-limiting embodiments.

DETAILED DESCRIPTION

Figure 1:
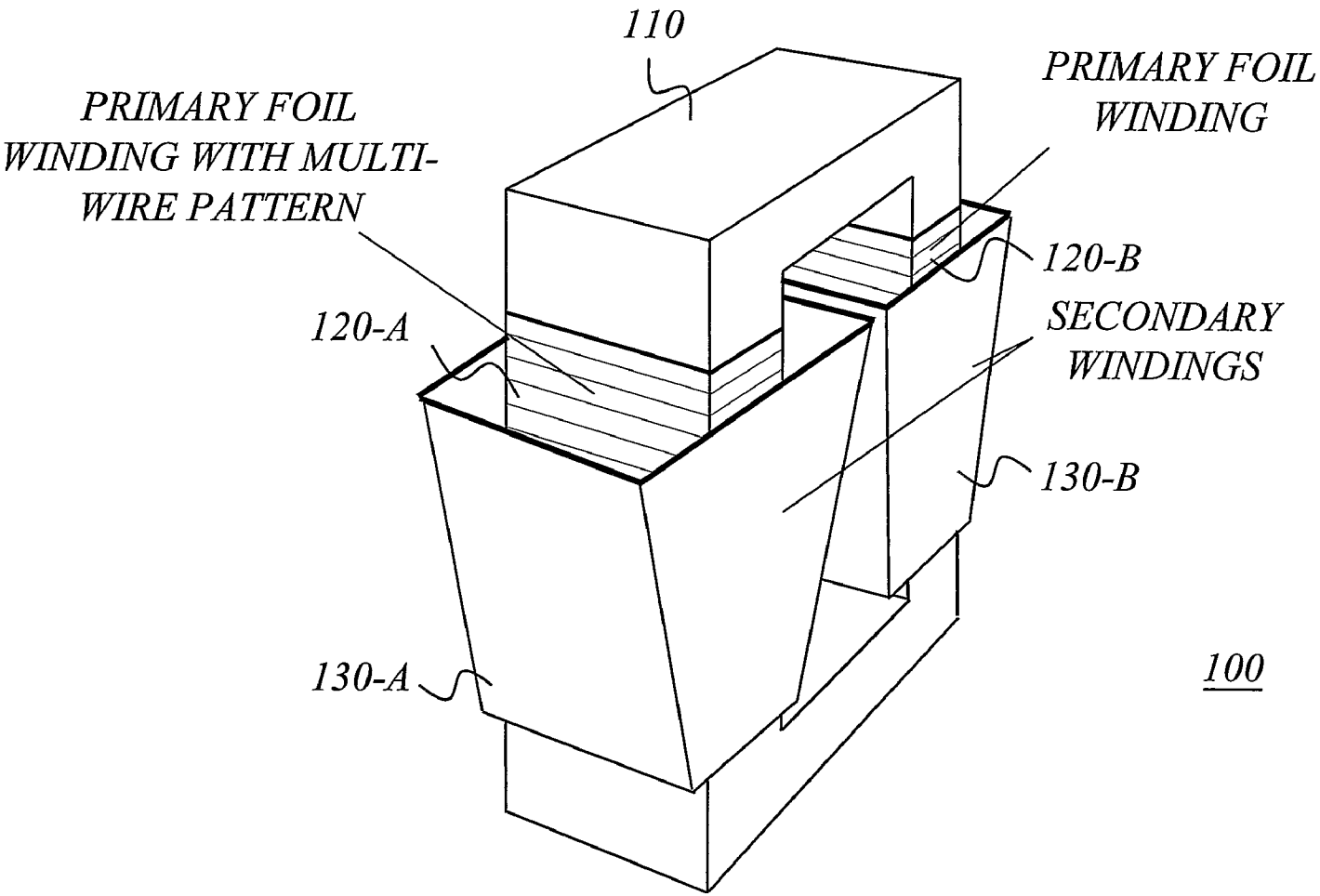
FIG. 1 is a schematic drawing illustrating an example of a pulse transformer arrangement according to a preferred example, non-limiting embodiment.

For a better understanding it may be useful to start with an analysis of the conventional way to design a pulse transformer.

To allow for practical application of the coils/windings, the core is traditionally cut into two halves. When the halves are reconnected, the gap left must be minimized and therefore the surfaces have to be ground flat and possibly etched to eliminate shorts between the tape layers. There must also be a thin insulation between the halves for this reason.

However, the inventors have recognized that the introduction of the cut has some effects on the performance of the transformer:

Assuming, by way of example, that the remaining gaps at the cut is around 0.05 mm it will require some H-field (say 80 ampere turns) to drive a 1 T field across the gaps. This is advantageous in the way that it will bring the remnant field to near zero at zero current, leaving something like 1 to 1.5 T field rise available for the pulse. With no gap the remnant field may be around 1 T, leaving only 0 to 0.5 T for the pulse. However, for the efficient use of the core, a DC current is often applied on an extra winding to offset the field at zero primary current to a negative field of about 1 to 1.5 T. Thereby a field swing of up to 3 T is left for the pulse. The gap requires most of this current, and has therefore a negative effect, requiring larger current supply components. With no cut the DC reset current is typically reduced by a factor of four. In addition to the extra costs involved for cutting the core, there is also an increased risk for electrical shorts.

The type of pulse transformer using several primary supplies, e.g. as described in our U.S. Pat. No. 5,905,646, also published as International PCT Application PCT/SE97/02139 with International Publication Number WO 98/28845 A1, and our U.S. Pat. No. 6,741,484, also published as International PCT Application PCT/SE02/02398 with International Publication Number WO 03/061125 A1, results in multiple primary windings. With conventional technique, the work to set up all these windings and to make connections for the windings is time consuming and costly.

There is thus a general need for an improved pulse transformer design.

A pulse transformer arrangement is provided based on an uncut pulse transformer core and at least one foil winding having multiple insulated conducting strips arranged around the core and ending in foil winding terminals to form multiple independent primary windings.

In the example schematically illustrated in FIG. 1, the pulse transformer arrangement 100 basically comprises an uncut core 110, two foil windings 120-A, 120-B and two secondary windings 130-A, 130-B. Each foil winding 120 has multiple insulated conducting strips arranged around the core to form multiple independent primary windings in a "multi-wire" pattern. Each foil winding can also be referred to as a primary foil winding with a multi-wire pattern.

In a preferred example, non-limiting embodiment, the multiple primary windings and their terminations are formed on a single conducting foil deposited on an insulating foil. The conducting foil is made of some suitable conducting material such as for example copper. Conveniently, the multi-strip foil winding 120 only needs to be wrapped a single turn around the uncut transformer core to form a set of independent (i.e. insulated from each other) primary windings with end terminals ready for connection. The multiple conducting strips are generally insulated from each other and extend around the core.

The "wires" (conducting strips) are preferably shaped on the conducting foil with a common photo-chemical method, for example by using standard printed circuit board manufacturing techniques.

In a preferred example, non-limiting embodiment, with the foil technique, the primary windings and their terminations are shaped on a single conducting foil (deposited on an insulating foil) and the connections are made simply by attaching for example standard multi-pin connectors (e.g. 15 pins). This is another significant advantage. Although the multi-pin connector arrangement is highly efficient from a manufacturing point of view, it is indeed possible to use any other commercially available connection arrangement such as conventional terminal blocks soldered to a printed circuit board or soldered into cable.

Another advantage with the foil winding is that it may easily cover the full length of the opening of the core with an almost continuous current sheet, which gives a smooth distribution of the electric field. This decreases the inductance and risk for sparking.

Making the winding(s) of foil eliminates the need to cut the core, because of the ease of insertion of the foil winding(s) onto the core. The work to set up a plurality of primary windings is significantly reduced. In addition to the elimination of the costs for cutting the core, this also brings the further advantages of reduced DC reset current and reduced risk for electrical shorts. A side effect of the new winding principle is that excessive losses due to potential high frequency AC resistance problems are avoided.

The secondary winding(s) can be any conventional winding(s), and is/are preferably multi-turn secondary winding(s).

Foil windings as such are known from the prior art [1-4], but for different applications and with a different design principle.

In reference [1] a foil winding in the form of a single-strip foil is wrapped in many layers around a conventional core with suitable interwinding insulation between layers.

Reference [2] relates to a low-voltage foil winding for a high-voltage television line transformer. The foil winding is arranged about a core, and the layers of the winding are insulated from each other by an insulating tape which is wound simultaneously with a conductive foil. The conductive foil forms an uninterrupted conductive surface so that the field lines in the central portion extends parallel to the winding.

Reference [3] relates to a power supply conductor from a conductive foil of a foil winding of a power transformer. The power supply conductor is formed as a conductor stack of flag-shaped folded end-pieces at one end of the foil winding, and represents a simple way to provide a narrow stack-formed end terminal from a wider piece of foil.

Reference [4] relates to a self lead foil winding for transformers and inductors. The end portion of a conventional multi-layered foil winding is cut into flag shaped portions that are folded or otherwise formed to create stacked self leads. The flag-shaped portions are made sufficiently long so that the resulting stacked self leads will reach a mounting board for efficient mounting of the transformer to the board.

Figure 2:
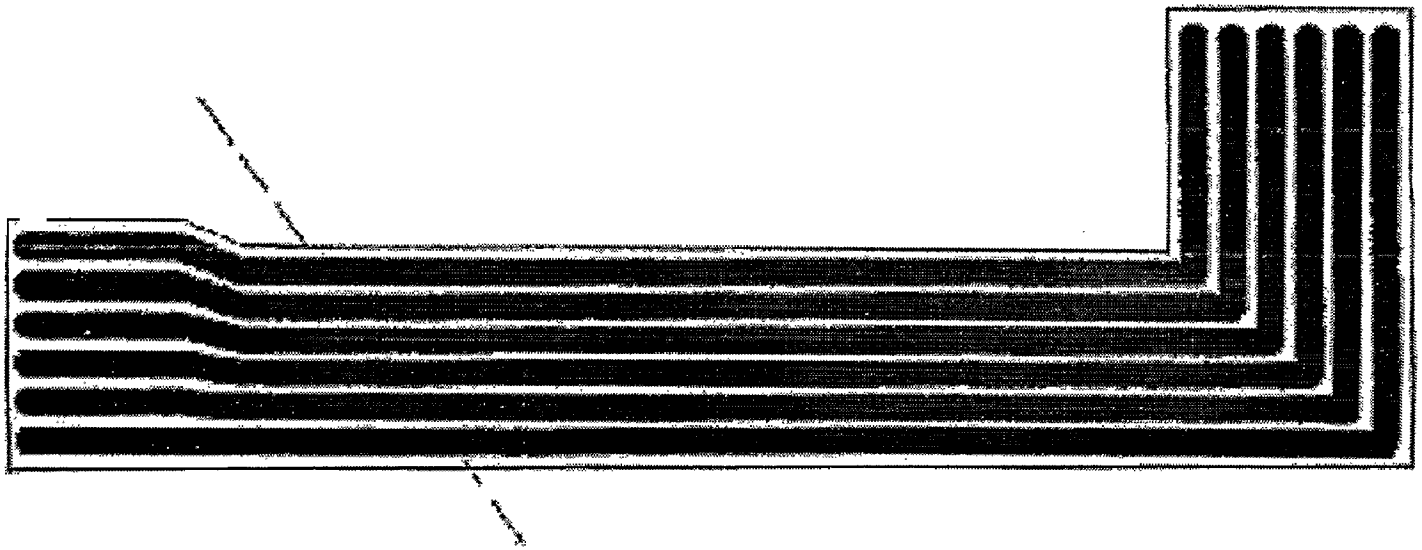
FIG. 2 illustrates a multi-strip foil winding according to an example, non-limiting embodiment.

FIG. 2 illustrates a winding according to an example embodiment. A foil of suitable conducting material (e.g. copper) is deposited on a foil of insulating material (e.g. plastic material), and strips of the conducting foil are formed in a suitable wire pattern, e.g. by using a conventional etching technique. The foil winding 120 illustrated in FIG. 2 is especially suitable for multiple primary windings. The separated multiple conducting strips or wires preferably extend all the way along the foil winding. Preferably, the primary foil winding is wrapped a single turn around the transformer core, and one end of the winding is then folded at about 45 degrees (as shown as a dotted line in FIG. 2) and the other end is configured with a turn at about 90 degrees so that the conductors for the incoming current (input terminals) can be arranged very close to the conductors for the outgoing current (output terminals) when the two ends are finally collected together. This decreases leakage fields.

Figure 3:
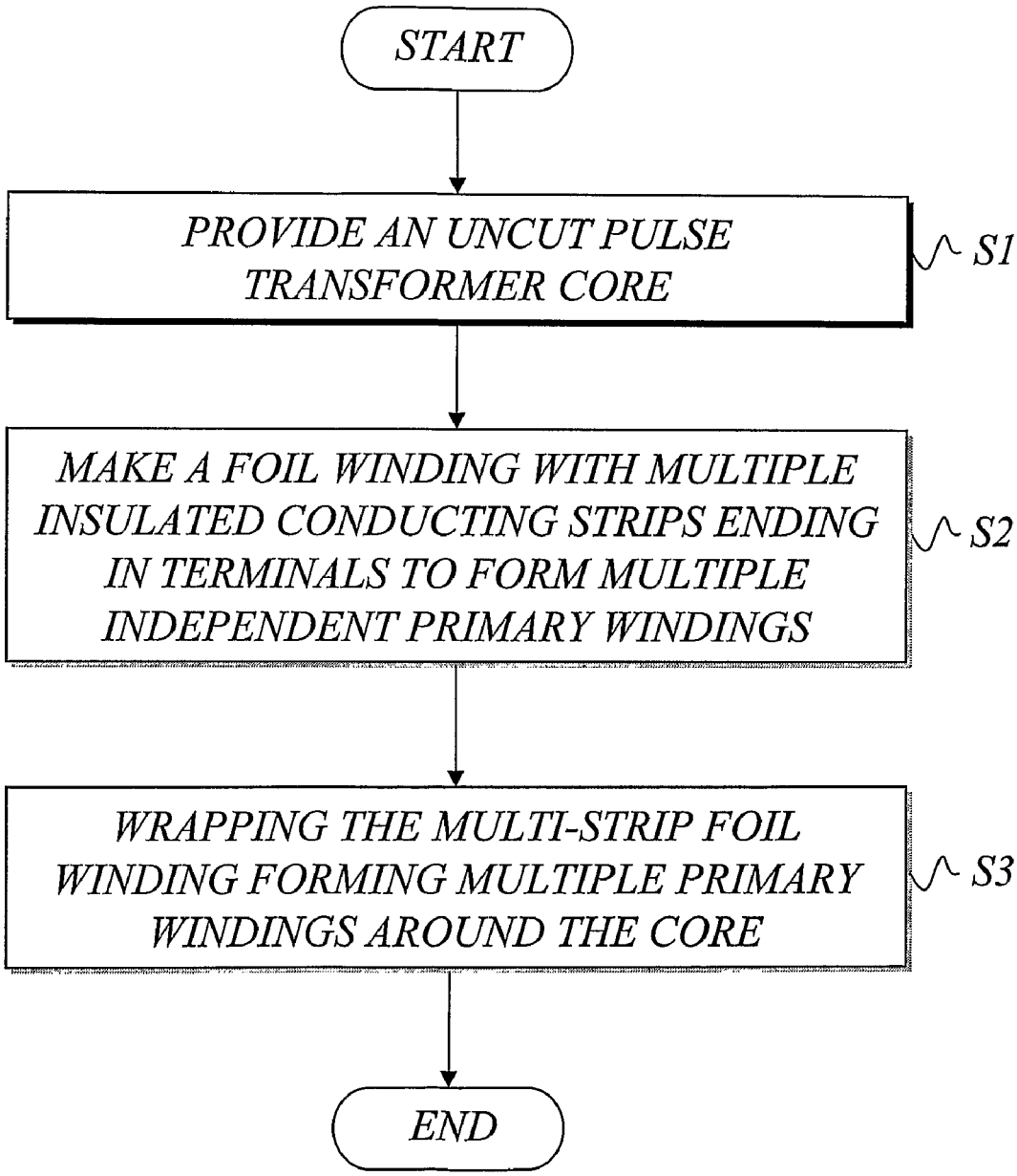
FIG. 3 is a schematic flow diagram of a method for manufacturing a pulse transformer arrangement according to an example, non-limiting embodiment.

FIG. 3 is a schematic flow diagram of a method for manufacturing a pulse transformer arrangement according to an example embodiment. The first step (S1) is to provide an uncut pulse transformer core. The next step (S2) is to make a pulse transformer foil winding with multiple insulated conducting strips ending in foil winding terminals to form a set of confined multiple independent primary windings. For example, the multi-strip foil winding is preferably made by depositing a foil of conducting material on a foil of insulating material, and forming multiple conducting strips in a wire pattern on the conducting foil. Subsequently, the multi-strip foil winding forming multiple primary windings is wrapped around the uncut transformer core (S3). Optionally, the terminals or end portions of the multiple conducting strips are connected to a multi-pin connector or similar connection arrangement to provide connections for the multiple primary windings.

Figure 4:
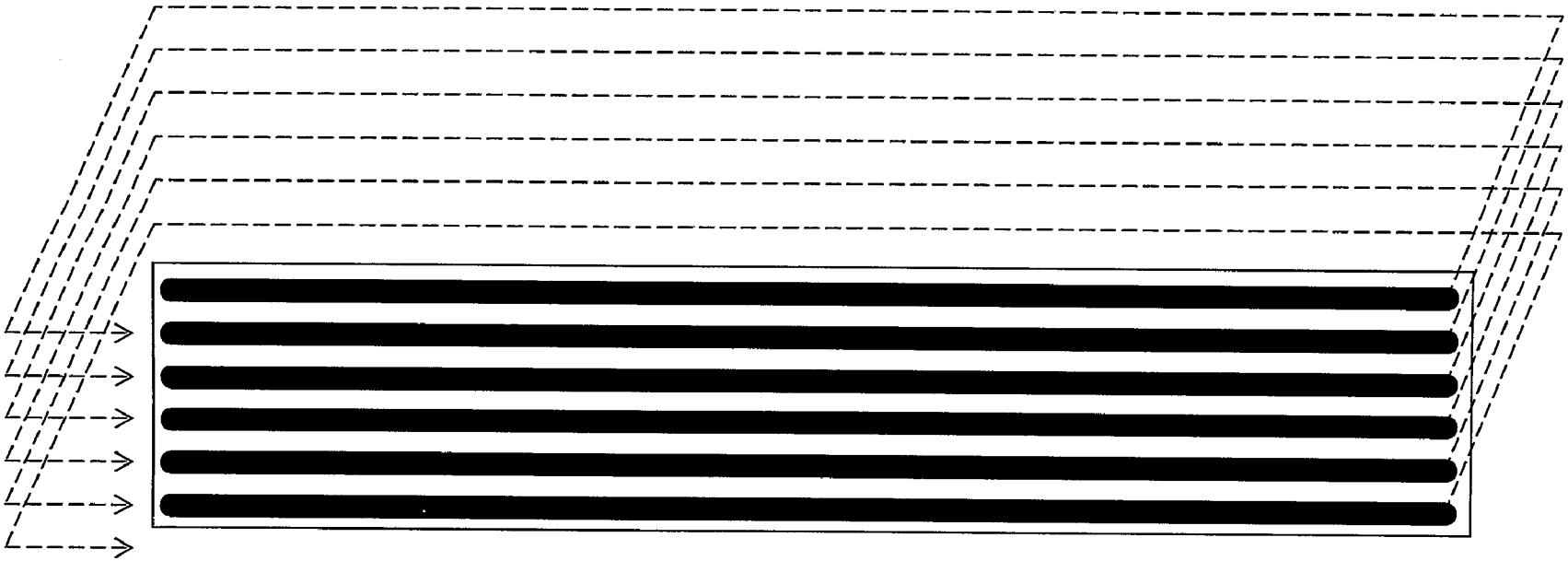
FIG. 4 illustrates a winding according to another example, non-limiting embodiment.

FIG. 4 illustrates a winding according to another example embodiment. This winding structure is especially suitable as a starting point for a secondary winding. The "wire pattern" on the foil is preferably displaced by one strip when the foil is wrapped (normally in a tapered overall shape) around the core and the meeting ends are soldered together to form the winding, as indicated by the dotted lines. The offset by one strip provides a natural starting end (input) and a terminating end (output) for the winding.

At present, foil with a thickness of more than 0.05 mm is not easily available on the commercial market. This may limit the average power of the transformer, unless several layers of foil are added in the process of making the windings.

Figure 5:
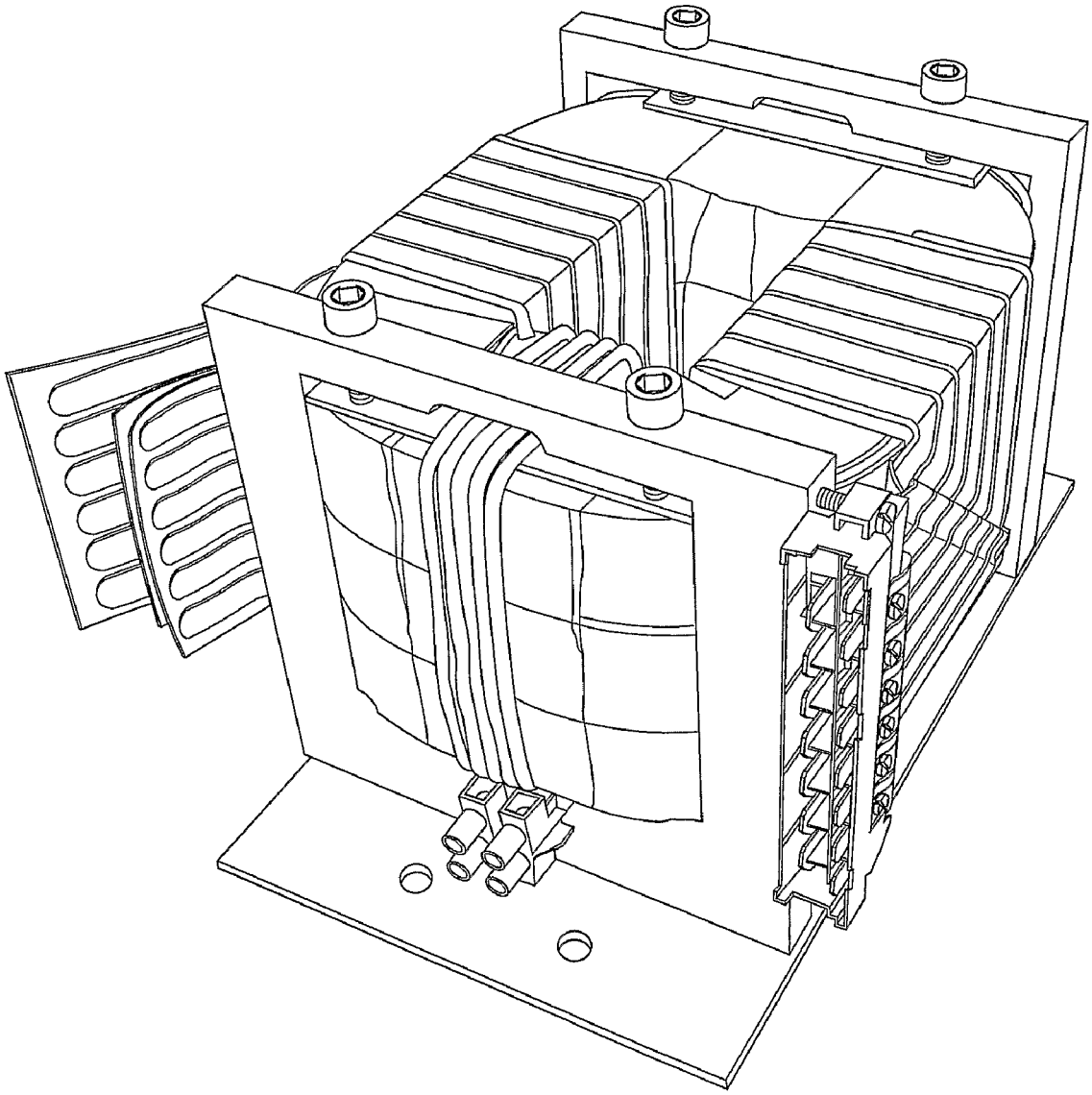
FIG. 5 shows a transformer arrangement with multiple primary foil windings according to an example, non-limiting embodiment.

FIG. 5 shows a transformer with primary foil windings without secondary winding. Please note that the transformer of FIG. 5 has two core legs, and that the primary winding on one of the legs is shown without connector to illustrate the close proximity between input and output conductors due to the smart and effective 45 degree fold, whereas the primary winding on the other leg is attached to a multi-pin connector.

Figure 6A:
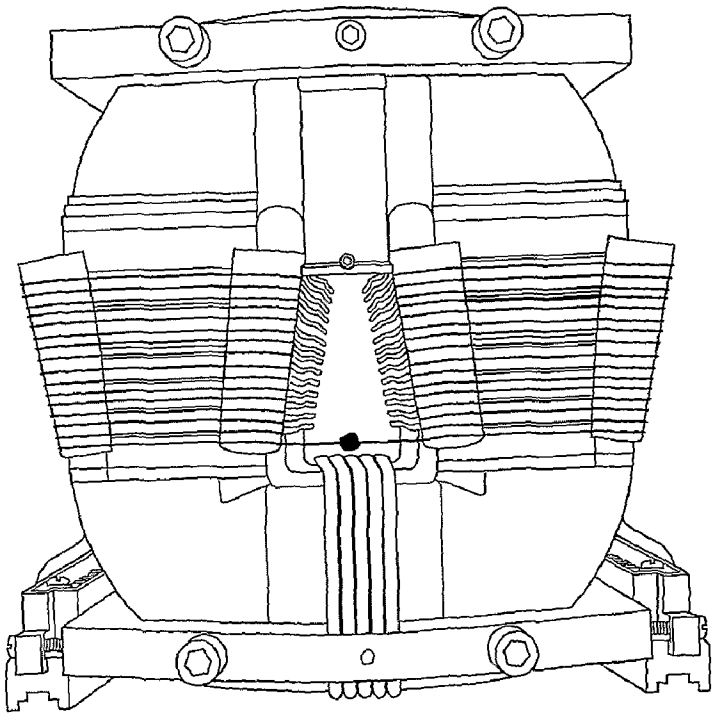
FIGS. 6A-B show different views of an example of a transformer with a novel foil-type primary winding according to a preferred example, non-limiting embodiment.
Figure 6B:
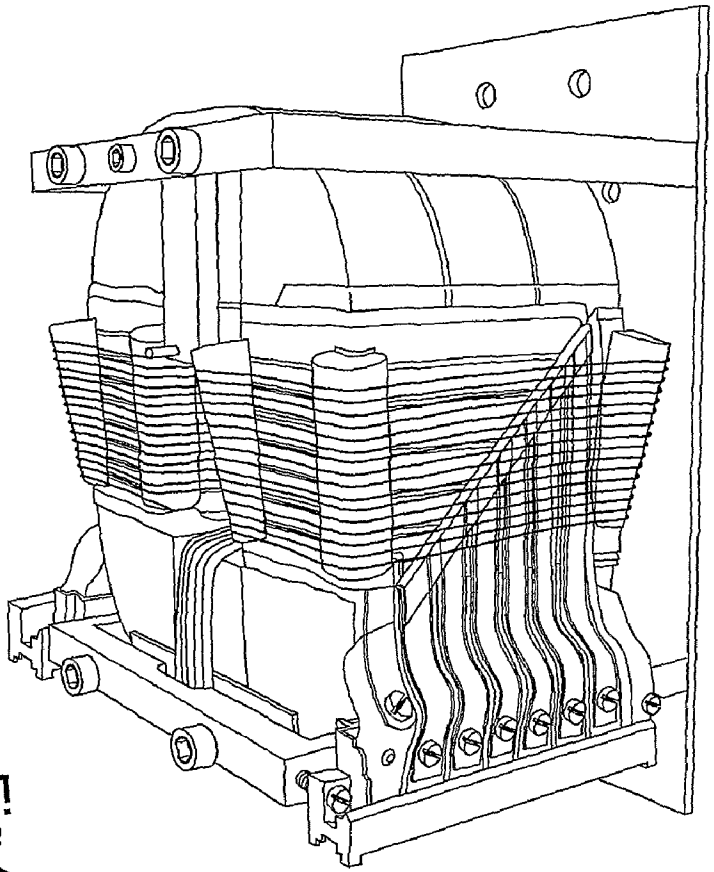

FIGS. 6A-B show different views of a complete transformer with a novel foil-type primary winding. In this particular realization the secondary winding is a conventional wire-type winding. There is of course nothing that prevents the secondary winding from being a foil-type winding.

In accordance with preferred example embodiments, at least one of the primary and secondary windings is/are made out of foil of some suitable conducting material such as for example copper deposited on insulating foil wrapped around the yoke.

Should the pulse transformer have more than one transformer core, it is possible to apply the described in this application with one or more foil windings on each transformer core.

The embodiments described above are merely given as examples, and it should be understood that the claims are not limited thereto. Further modifications, changes and improvements which retain the basic underlying principles disclosed herein are within the scope of the claims.

REFERENCES

[1] "Aluminum and Copper Foil Transformers", Technical Information, ElectroCube, www.electrocube.com, August 2006.

[2] U.S. Pat. No. 4,086,552

[3] U.S. Pat. No. 5,805,045

[4] U.S. Pat. No. 6,930,582

The invention claimed is:

1. A pulse transformer arrangement using several primary supplies for transferring pulse energy from a primary side having multiple primary windings to a secondary side, said pulse transformer arrangement comprising:

an uncut pulse transformer core;

multiple independent primary windings formed by a foil winding comprising multiple insulated conducting strips arranged around said uncut pulse transformer core and ending in foil winding terminals, wherein said foil winding is wrapped a single turn around said transformer core and said multiple conducting strips are insulated from each other and extend around the core; and a connection arrangement to which the terminals of said multiple conducting strips are connected to provide connections for said multiple independent primary windings.

2. The pulse transformer arrangement of claim 1, wherein said multiple conducting strips are formed in a wire pattern on a foil of conducting material deposited on a foil of insulating material.

3. The pulse transformer arrangement of claim 1, wherein the terminals of said multiple conducting strips are connected to a multi-pin connector to provide foil winding connections.

4. The pulse transformer arrangement of claim 3, wherein said foil winding is made from a flexible printed circuit board adapted for standard multi-pin connectors.

5. The pulse transformer arrangement of claim 1, wherein said uncut pulse transformer core has an opening of a length and said foil winding substantially covers the length of said opening of said uncut pulse transformer core to provide a smooth distribution of the electrical field.

6. The pulse transformer arrangement of claim 1, wherein at least a subset of said multiple conducting strips, in operation, are connected in parallel.

7. The pulse transformer arrangement of claim 1, wherein said foil winding is wrapped around the transformer core and one end of said foil winding is folded at about 45 degrees and the other end is configured with a turn of about 90 degrees so that input terminals can be arranged in close proximity to output terminals when the two ends of the foil winding are collected together.

8. The pulse transformer arrangement of claim 1, further comprising a secondary winding wrapped around the core.

9. A method of manufacturing a pulse transformer arrangement using several primary supplies for transferring pulse energy from a primary side having multiple primary windings to a secondary side, said method comprising the steps of:

providing an uncut pulse transformer core;

forming multiple independent primary windings by making a pulse transformer foil winding with multiple insulated conducting strips ending in foil winding terminals;

wrapping said foil winding that forms said multiple primary windings a single turn around said uncut transformer core, said multiple conducting strips being insulated from each other and extending around the core; and providing a connection arrangement to which the terminals of said multiple conducting strips are connected to provide connections for said multiple independent primary windings.

10. The method of claim 9, wherein said step of forming multiple independent primary windings by making a pulse transformer foil winding with multiple insulated conducting strips comprises the steps of:

depositing a foil of conducting material on a foil of insulating material; and forming multiple conducting strips in a wire pattern on the conducting foil.

11. The method of claim 9, wherein the terminals of said multiple conducting strips are connected to a multi-pin connector to provide connections for said multiple primary windings.

12. The method of claim 11, wherein said foil winding is made from a flexible printed circuit board adapted for standard multi-pin connectors.

13. The method of claim 9, wherein said uncut pulse transformer core has an opening of a length and said foil winding is arranged substantially over the full length of said opening of said uncut pulse transformer core to provide a smooth distribution of the electrical field.

14. The method of claim 9, further comprising the step of folding, after wrapping said foil winding around said uncut pulse transformer core, one end of said foil winding at about 45 degrees and the other end is configured with a turn of about 90 degrees so that input terminals can be arranged in close proximity to output terminals when the two ends of the foil winding are collected together.

15. The method of claim 9, wherein a secondary winding is further wrapped around said transformer core.

* * * * *